US006244695B1

(12) United States Patent
Udagawa

(10) Patent No.: US 6,244,695 B1
(45) **Date of Patent: *Jun. 12, 2001**

(54) LIQUID TANK

(75) Inventor: Kenta Udagawa, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/094,624

(22) Filed: Jun. 15, 1998

(30) Foreign Application Priority Data

Jun. 19, 1997 (JP) ..... 9-162130

(51) Int. Cl.[7] ..... B41J 2/175
(52) U.S. Cl. ..... 347/86
(58) Field of Search ..... 347/84, 85, 86, 347/87

(56) References Cited

U.S. PATENT DOCUMENTS 5,790,158 * 8/1998 Shinada et al. ..... 347/86
5,903,294 * 5/1999 Abe et al. ..... 347/87

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

A liquid tank includes a first chamber which incorporates a liquid and a negative pressure producing material and which includes an air communication port for obtaining communication with atmospheric air, and a port serving as an ink outlet. The liquid tank also includes a second chamber for directly accommodating the liquid to be supplied to the first chamber in a substantially closed state although communicating with the first chamber only via a communication port which is provided at a position separated from the air communication port. The communication port is formed between a partition wall for separating the first chamber from the second chamber, and a chamber inner surface which is a border region between the first chamber and the second chamber where an end portion of the partition wall contacts if the partition wall is extended. A liquid transfer channel which is longer than a length of the partition wall in the direction of the thickness of the partition wall is provided along the chamber inner surface of the communication port.

6 Claims, 4 Drawing Sheets

LIQUID TANK

BACKGROUND OF THE INVENTION

1. Field of the Invention

The present invention relates to a liquid tank for holding a liquid used for recording. More particularly, the invention relates to a liquid tank for ink-jet recording which can smoothly and sufficiently supply an ink-jet head with ink when it is mounted on the ink-jet head.

2. Description of the Related Art

Conventionally, a liquid tank for accommodating a liquid used for recording (hereinafter termed an "ink tank" or an "ink cartridge") is integrated with an ink-jet head. When ink within the cartridge becomes incapable of being discharged, the ink tank is, in most cases, disposed together with the head. The amount of ink remaining within the cartridge in this stage depends on the ink holding capability of a sponge, serving as a negative pressure producing material, accommodated in substantially the entire space within the cartridge, and is relatively large even if it is intended to improve the cartridge.

An ink tank or an ink receptacle of this kind is disclosed in Japanese Patent Laid-Open Application (Kokai) No. 63-87242 (1988). This ink receptacle incorporates a foamed material, and constitutes a cartridge integrated with an ink-jet head including a plurality of ink discharging orifices. In this ink receptacle, by storing ink in a porous medium, such as foamed polyurethane, serving as the foamed material, a negative pressure is generated due to the capillary force of foams, and the ink is held to prevent leakage of the ink from the ink receptacle.

However, since it is necessary to load the foamed material in substantially the entire space of the unique ink receptacle, the amount of filled ink is restricted, and the amount of ink remaining in the foamed material without being used is relatively large. Accordingly, the use of the foamed naterial becomes inefficient due to the amount of ink retained by the foamed material. There exist also the problems that it is difficult to detect the amount of remaining ink, and that the negative pressure gradually changes while the ink is being consumed, so that it is difficult to maintain a substantially constant negative pressure for a long period.

In contrast to this configuration, an ink cartridge which holds substantially only ink is disclosed in Japanese Patent Laid-Open Application (Kokai) No. 2-522 (1990). In this ink cartridge which is integrated with an ink-jet head, a small porous member is disposed between a primary ink tank for holding only a large amount of ink which is provided at an upper portion, and the ink-jet head provided at a lower portion. It is claimed that this ink cartridge can improve the efficiency of use of ink because the porous member is disposed only in an ink channel instead of being incorporated within the ink tank. It is also claimed that, by providing a secondary ink tank, serving as a space capable of holding ink, at a side of the porous member, ink drawn from the primary ink tank due to the expansion of the air within the primary tank caused by temperature rise (a decrease in the pressure) is stored in the secondary ink tank, so that the negative pressure for the print head during printing can be maintained substantially constant.

However, in this ink cartridge, since excessive ink is impregnated in the porous member from the primary ink tank for holding only a large amount of ink which is provided at the upper portion, a negative pressure is hardly generated in the porous member. Hence, there is the possibility that ink leaks from an orifice of the ink-jet head by a slight jolt. Hence, this ink cartridge is not suitable for practical use. If an exchangeable ink cartridge which is mounted on an ink print head is adopted in this configuration, ink leaks because of the above-described state of the porous member. Hence, this cartridge is not practially for use.

An ink cartridge, in which ink is sealed within a bag, and a spring for maintaining the negative pressure of the bag constant is provided, is also known. However, this configuration increases the production cost, and it is difficult to achieve mass production of such ink cartridges while maintaining the performance of the spring.

As described above, none of conventional (non-contact-printing) ink cartridges for ink-jet printing are inexpensive and have a rational technical level.

The assignee of the present application has proposed, for example, in U.S. Pat. Nos. 5,509,140 and 5,619,238, ink receptacles suitable for the technical field of ink-jet printing which satisfy the conditions of excellent supply of ink corresponding to the amount of ink discharged from a head during printing, a high efficiency of use of ink, and occurrence of no problems, such as leakage of ink from a discharging port, and the like, while printing is not performed. Such an ink receptacle includes a first chamber incoporating a negative pressure producing material and including an air communication port for obtaining communication with atmospheric air, and a second chamber for directly accommodating ink to be supplied to the first chamber in a substantially closed state although communicating with the first chamber only via a communication port. The communicating port is provided at a part of a partition wall for separating the first chamber from the second chamber.

In this ink receptacle, ink is consumed when the ink is supplied to the ink-jet head side via an ink outlet provided in the first chamber. At the moment when a part of the liquid surface of the ink in the first chamber reaches the upper portion of the communication port, the inside of the second chamber which has been in a substantially closed state starts to communicate with atmospheric air to supply an air bubble into the second chamber. At the same time, the ink in the second chamber is supplied to the first chamber via the communication port. Mutual supply of the gas (an air bubble) and the liquid (ink) at the communication port will be hereinafter termed gas-liquid exchange. In the receptacle having this configuration, gas-liquid exchange is performed, so that the ink within the second chamber is supplied and consumed.

Since this configuration has a tank structure which can maintain the negative pressure substantially constant (at least while the ink within the second chamber is being consumed) during most of the time from the start of use to the end of use of the ink-jet cartridge, it is possible to provide a cartridge for ink-jet recording which can be used even for high-speed printing.

In the ink cartridge having the above-described configuration, the size of the air bubble generated during gas-liquid exchange while the ink is being consumed greatly increases depending on the shape of the opening of the communication port, and the surface tension and the viscosity of the air bubble which depend on the type, the components and the like of the accommodated ink, and the grown air bubble may remain in the communication port. In such a case, there is the possibility that gas-liquid exchange via the communication port is hindered from stopping the supply of ink from the first chamber to the second chamber.

However, since the shape and the size of the opening of the communication port are limited by various factors, such as the external shape of the cartridge, and the like, there is little room for changing the shape and the size. Furthermore, characteristics, such as the surface tension of ink, and the like, are determined by the use of the cartridge, and the like.

SUMMARY OF THE INVENTION

It is an object of the present invention to provide a liquid tank configured so that gas-liquid exchange can be safely and assuredly achieved and ink can be stably supplied even if a grown air bubble remains in a communication port.

It is another object of the present invention to provide a structure of a liquid tank which allows movement of an air bubble generated by gas-liquid exchange to a second chamber for storing ink without remaining in a communication port.

Surface tension is one of reasons why an air bubble remains in the communication port when gas-liquid exchange is effected. When an air bubble formed during gas-liquid exchange adheres to the inner wall of a receptacle constituting an ink tank, a contact angle (between the liquid (ink) and the surface of the wall) determined by the surface tension is present on a contact border line between the air bubble and the wall. In order to effect gas-liquid exchange, it is necessary to peel the air bubble from the wall with a force exceeding the contact angle.

In the present invention, in order to reduce the peeling force by reducing the contact area of the air bubble, projections or grooves are formed at the communication port. At that time, if the air bubble enters a projection or a groove formed at the communication port, the border line of the contact surface between the air bubble and the wall further increases. That is, when the width and the height (depth) of the projection or the groove are substantially the same as the diameter of the air bubble generated by gas-liquid exchange, the air bubble enters a groove formed between the adjacent projections or in one of the grooves and it is difficult to extract the air bubble. Accordingly, it is necessary to make the projections or the grooves formed at the communication port narrower than the diameter of the air bubble formed during gas-liquid exchange in order to prevent the air bubble from entering the above-described groove. If the depth of the groove is too small, there is the possibility that the air bubble enters the groove. Hence, the depth is preferably close to the value of the diameter of the air bubble.

There is no particular limitation in the shape of the opening constituting the communication port, provided that the contact surface between the air bubble and the wall does not increase by providing the projections or the grooves.

According to one aspect, the present invention which achieves these objectives relates to a liquid tank including a first chamber which incorporates a liquid and a negative pressure producing material and which includes an air communication port for obtaining communication with atmospheric air, and a supply port serving as an ink outlet, and a second chamber for directly accommodating the liquid to be supplied to the first chamber in a substantially closed state although communicating with the first chamber only via a communication port which is provided at a position separated from the air communication port. The communication port is formed between a partition wall for separating the first chamber from the second chamber, and a chamber inner surface which is a border region between the first chamber and the second chamber where an end portion of the partition wall contacts if the partition wall is extended. A liquid transfer channel which is longer than a length of the partition wall in a direction of the thickness of the partition wall is provided along the chamber inner surface facing the communication port.

In this configuration, even if an air bubble remains at an upper portion of the communication port, the liquid in the second chamber can be assuredly and sufficiently supplied to the first chamber by being transferred along the liquid transfer channel provided at a lower portion of the communication port. Even if an air bubble remaining in the communication port regulates the interface of the liquid within the second chamber and separates the interface of the liquid from the communication port, by making the liquid transfer channel long so as to contact the interface of the liquid, the liquid can be assuredly supplied to the first chamber. It is possible to thus provide an air guiding channel at an upper portion of the communication port and to provide the liquid transfer channel at a lower portion of the communication port by utilizing the surface tension of the air bubble.

From such a viewpoint, the liquid transfer channel is preferably disposed so as to be longer to the second chamber side than to the first chamber side.

The liquid transfer channel is preferably decreasingly sloped toward the negative pressure producing material in the first chamber. The application or release of a partial pressing force for the negative pressure producing material must be avoided as much as possible in consideration of influence on the distribution of the negative pressure within the negative pressure producing material. If it cannot be avoided, the amount of changes in the pressing force must be minimized. For that purpose, it is necessary to mitigate the influence of the partial negative pressure whether the liquid transfer channel is concave or convex.

The liquid transfer channel may include at least one projection projected from the chamber inner surface of the communication port or at least one recess formed in the chamber inner surface of the communication port.

A plurality of projections or recesses may be formed in the liquid transfer channel.

The plurality of projections or recesses of the liquid transfer channel may be extended in directions of the thickness of the partition wall.

The recesses as a liquid guiding channel may be provided between the plurality of projections of the liquid transfer channel.

The supply port of the first chamber may face the air communication port, and may be provided at a wall portion of the first chamber where the liquid transfer channel at the communication port is formed.

The foregoing and other objects, advantages and features of the present invention will become more apparent from the following description of the preferred embodiments taken in conjunction with the accompanying drawings.

BRIEF DESCRIPTION OF THE DRAWINGS

FIG. 2(*a*) is a cross-sectional view of a principal portion of the communication port, and FIG. 2(*b*) is a cross-sectional view taken along line b—b shown in FIG. 2(*a*);

FIG. 3(*a*) is a cross-sectional view of a principal portion of the communication port, and FIG. 3(*b*) is a cross-sectional view taken along line b—b shown in FIG. 3(*a*); FIG. 4(*a*) is a cross-sectional view of a principal portion of the communication port, and FIG. 4(*b*) is a cross-sectional view taken along line b—b shown in FIG. 4(*a*).

DESCRIPTION OF THE PREFERRED EMBODIMENTS

Preferred embodiments of the present invention will now be described with reference to the drawings.

First Embodiment

Figure 1:
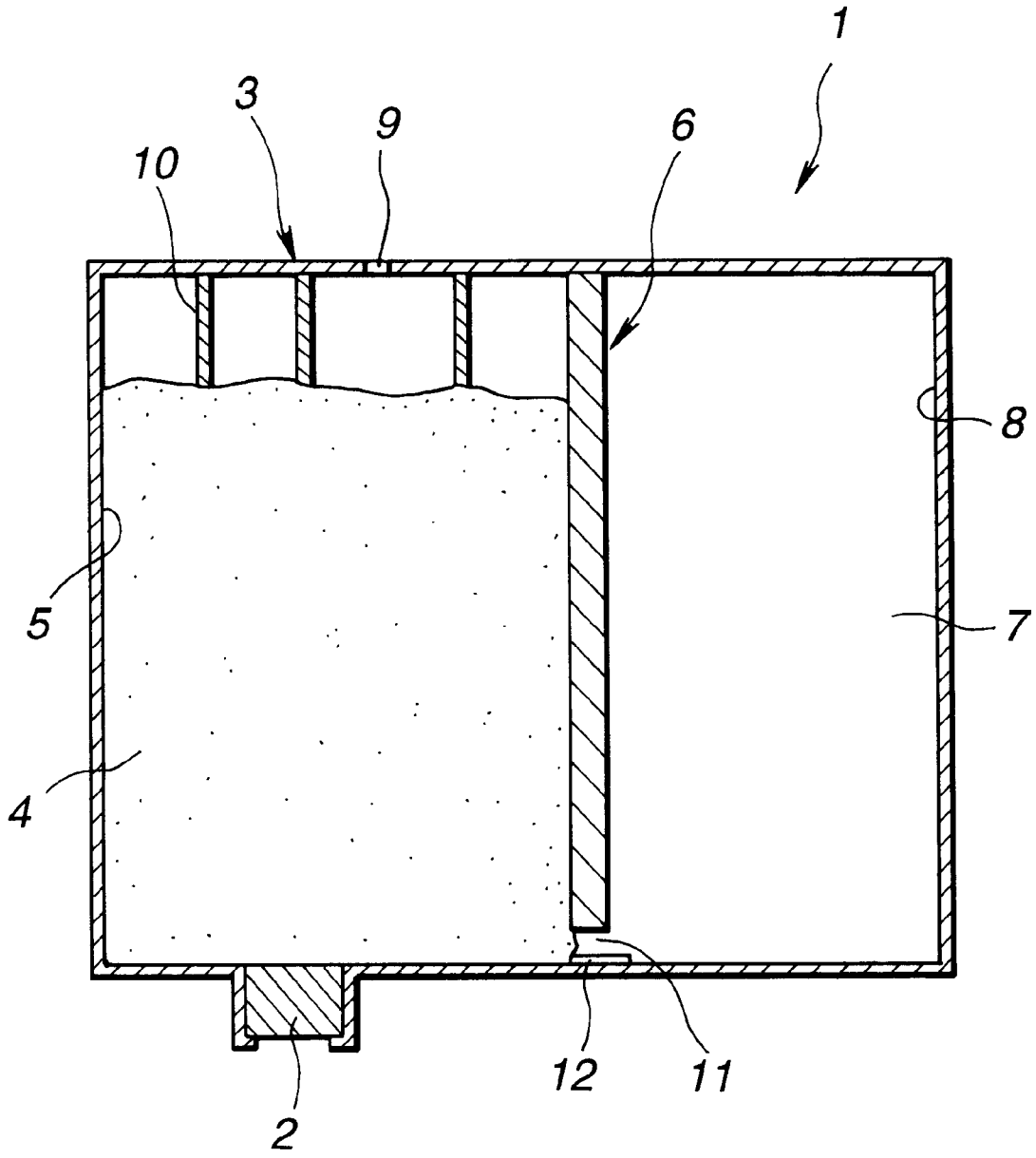
FIG. 1 is a cross-sectional view illustrating the configuration of an ink cartridge, serving as an ink tank, according to a first embodiment of the present invention.

FIG. 1 is a schematic cross-sectional view illustrating the configuration of an ink tank according to a first embodiment of the present invention. In FIG. 1, reference numeral 1 represents a cartridge main body for ink-jet recording (hereinafter abbreviated as a "cartridge main body"). The cartridge main body 1 includes, mainly, an opening 2, serving as an ink outlet for supplying an ink-jet head (not shown) with ink by being connected to the ink-jet head, an air communication port 3 communicating with atmospheric air, a first ink chamber 5 incorporating a negative pressure producing material 4, and a second ink chamber 8 which directly accommodates ink in a state of being adjacent to the first ink chamber 5 via a partition wall 6.

The air communication port 3 includes, mainly, an air communicating hole 9 for causing the inside of the cartridge main body 1 to communicate with atmospheric air, and a plurality of ribs 10 for preventing the negative pressure producing material 4 from directly contacting the air communication hole 9 and for forming an air buffer in a region surrounding the air communication port 3.

A communication port 11 for supplying the first ink chamber 5 with ink 7 within the second ink chamber 8 is formed between a base end portion of the partition wall 6 and the base of the cartridge main body 1. Projections 12 are provided in the communication port 11.

Next, the configurations of the communication port 11 and the projections 12 will be described in detail with reference to FIGS. 2(*a*) and 2(*b*).

Figure 2B:
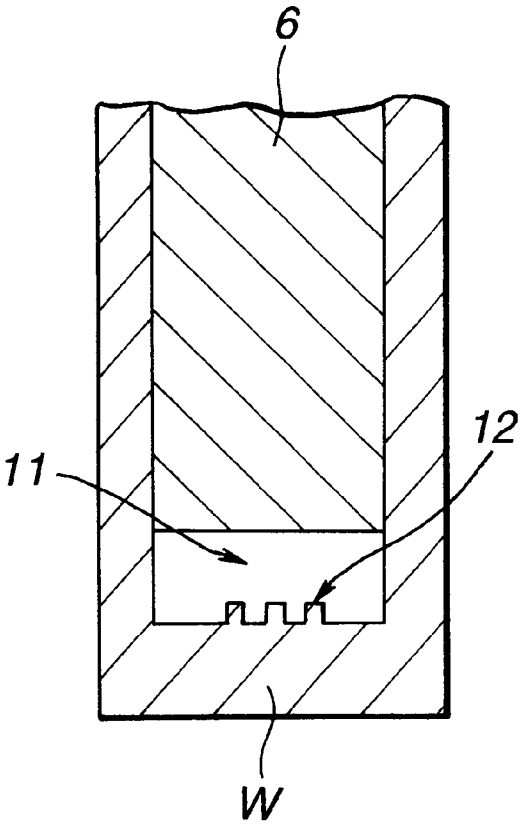
FIGS. 2(*a*) and 2(*b*) are diagrams illustrating the configuration of a surrounding structure of a communication port in the first embodiment.
Figure 2A:
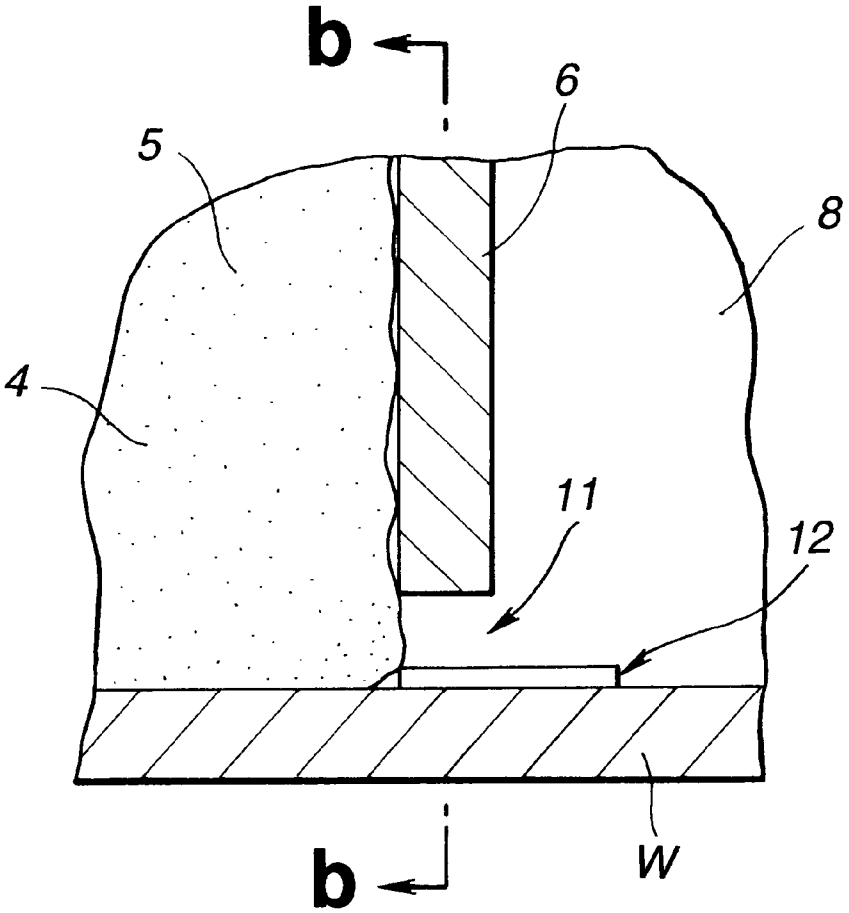

FIGS. 2(*a*) and 2(*b*) are diagrams illustrating the configuration of a surrounding structure of the communication port 11 in the first embodiment: FIG. 2(*a*) is a cross-sectional view of a principal portion of the communication port 11, and FIG. 2(*b*) is a cross-sectional view taken along line b—b shown in FIG. 2(*a*).

As shown in FIGS. 2(*a*) and 2(*b*), the communication port 11 is formed between the partition wall 6 and a wall w of the cartridge main body 1. A plurality of (three in the first embodiment) projections 12 is formed on the upper surface of the wall w in the direction of the thickness of the partition wall 6 from the inside of the communication port 1 toward the second ink chamber 8. One end portion (the left end in FIG. 2(*a*)) of each of the projections 12 contacts a base portion of the negative pressure producing material 4 in the first ink chamber 5, and another end (the right end in FIG. 2(*a*)) extends to the inside of the second ink chamber 8. Although the length of the projection 12 within the second ink chamber 8 is determined based on the surface tension of the ink 7, the shape of the communication port 11, and the like, it must be greater than the size of a grown air bubble which is considered to remain within the communication port 11 during the above-described air-liquid exchange. Accordingly, in general, the length of the projection 12 is preferably at least 2 mm. However, the length is not limited to this value. The reason why the length of the projection 12 must be greater than the size of the air bubble remaining in the communication port 11 is that, even if an air bubble having an ordinary size remains in the communication port 11, since the right end of the projections 12 reaches the air-liquid interface of the ink 7 within the second ink chamber 8, the ink 7 can be supplied into the first ink chamber 5 through the projections 12.

The height from the upper surface of the wall w and the width of the projection 12 are set to values to allow air-liquid separation by the surface tension of the air bubble, and are preferably about 0.5 mm. The height of the projection 12 is preferably a value equal to or less than the size of an air bubble formed by air-liquid exchange. Hence, if the air bubble has a diameter equal to or more than 1 mm, the height may be equal to or less than 1 mm. The height may be set to a value within a range to allow the movement of the liquid. Hence, even a height equal to or more than 1 mm will cause no particular problem.

The number of the projections 12 is determined by the width of the opening of the communication port 11, and the like. In order to provide a difference between the cross section of a bubble-guiding channel provided at an upper portion of the opening of the communication port 11 and the cross section of the liquid transfer channel provided at a lower portion of the opening of the communication port 11 so as to prevent a large grown air bubble from entering between the projections 12, it is desirable to provide a plurality of projections 12. It is desirable to determine the interval between the adjacent projections 12 in consideration of the size of the formed air bubble. For example, as described above, the interval is desirably equal to or less than the size of the air bubble. When the air bubble has a diameter of at least 1 mm, the interval is desirably equal to or less than 1 mm.

In the first embodiment, at the moment when the liquid surface of the ink stored within the negative pressure producing material 4 of the first ink chamber 5 decreases in accordance with consumption of the ink and a part of the liquid surface reaches the communication port 11, the inside of the second ink chamber 8 communicates with the first ink chamber 5 via the air communicating hole 9 of the first ink chamber 5, and an air bubble is supplied into the second ink chamber 8. At the same time, ink having a volume corresponding to the air bubble is supplied to the first ink chamber 5 via the communication port 11. By repeating such gas-liquid exchange, there is the possibility that air bubbles remain within the communication port 11.

In the first embodiment, however, even if an air bubble remains, since a transfer channel for the ink is always secured at a lower portion of the communication port 11 by a liquid transfer channel provided by projections 12 where an air bubble cannot enter, the ink can be supplied from the second ink chamber 8 to the first ink chamber 5. Hence, not only ink contained in the negative pressure producing material 4 within the first ink chamber 5 but also ink within the second ink chamber 8 communicating at the communication port 11 can be entirely consumed effectively.

Furthermore, as described above, by assuredly supplying ink from the second ink chamber 8 to the first ink chamber 5, an air bubble is received into the second ink chamber 8, so that the stay of the air bubble within the communication port 11 can be prevented. In such a case, since not only the liquid transfer channel at a lower portion of the communication port 11 but also an upper channel can be utilized for supplying ink, ink can be smoothly and sufficiently supplied. In addition, since the contact area of an air bubble on the wall decreases due to the presence of the projections 12, the remaining air bubble can be easily moved.

Second Embodiment

Figure 3B:
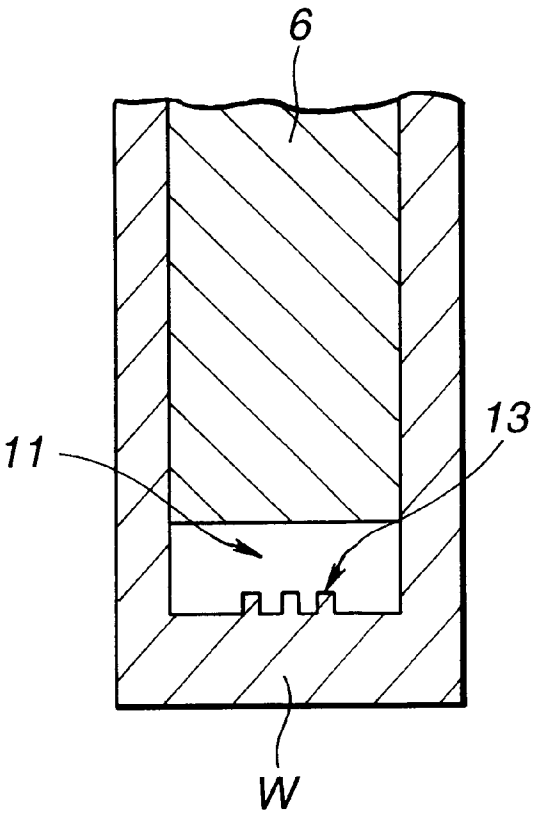
FIGS. 3(*a*) and 3(*b*) are diagrams illustrating the configuration of a surrounding structure of a communication port of an ink cartridge, serving as an ink tank, according to a second embodiment of the present invention.
Figure 3A:
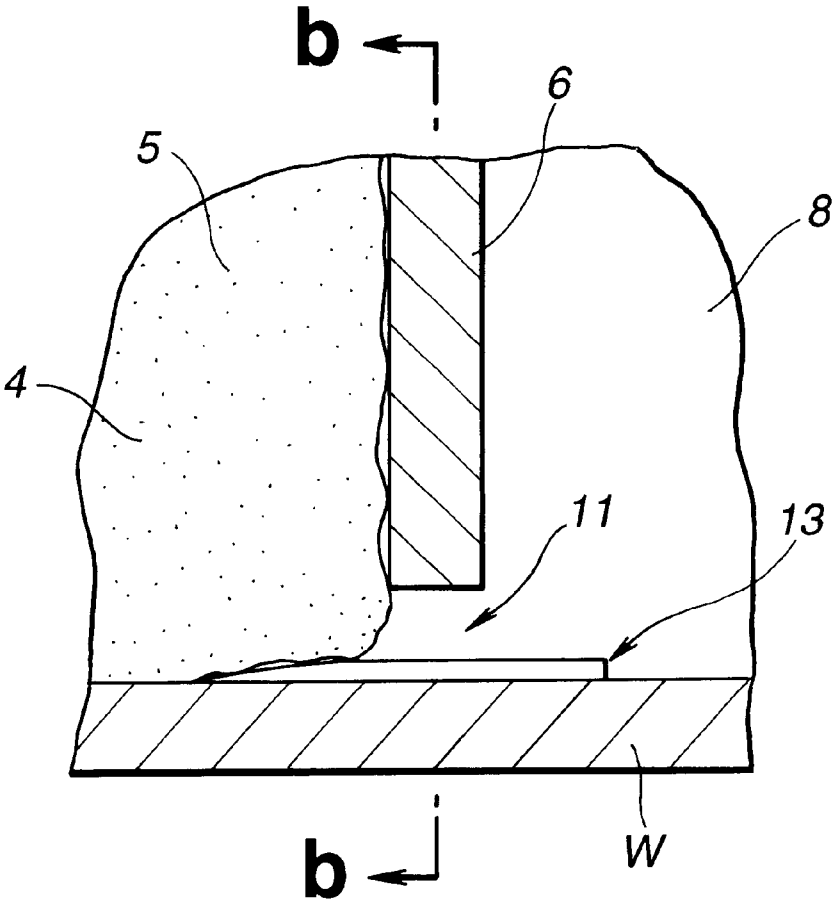

FIGS. 3(*a*) and 3(*b*) are diagrams illustrating the configuration of a surrounding structure of a communication port of an ink cartridge, serving as an ink tank, according to a second embodiment of the present invention: FIG. 3(*a*) is a cross-sectional view of a principal portion of the communication port, and FIG. 3(*b*) is a cross-sectional view taken along line b—b shown in FIG. 3(*a*).

The configuration of the second embodiment is basically the same as that of the first embodiment except for a communication port 11 (to be described below). Hence, the same components are indicated by the same reference numerals, and further description thereof will be omitted. The second embodiment has a feature in the shape of projections 13, serving as a liquid transfer channel provided at a lower portion of the communication port 11. The projections 12 of the first embodiment only slightly contact the negative pressure producing material 4, and does not extend to the inside of the negative pressure producing material 4. To the contrary, the projections 13 of the second embodiment extend to the inside of a lower portion of the negative pressure producing material 4, and a portion entering the lower portion of the negative pressure producing material 4 is sloped so that its height gradually decreases as it enters the inside.

It is considered that when unsloped projections contact the negative pressure producing material 4, the compressibility of the negative pressure producing material 4 abruptly changes, thereby influencing the stability of insertion of an absorbed material. To the contrary, in the second embodiment having the sloped projections 13, the contact between the sloped portion and the negative pressure producing material 4 is mitigated, so that the negative pressure within the negative pressure producing material 4 does not abruptly change, so that ink supplied from the second ink chamber 8 is easily accommodated within the negative pressure producing material 4.

Third Embodiment

Figure 4B:
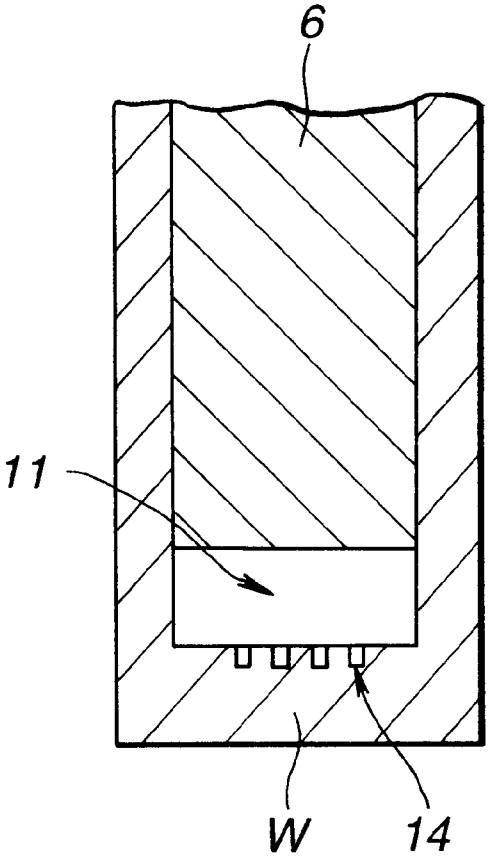
FIGS. 4(*a*) and 4(*b*) are diagrams illustrating the configuration of a surrounding structure of a communication port of an ink cartridge, serving as an ink tank, according to a third embodiment of the present invention.
Figure 4A:
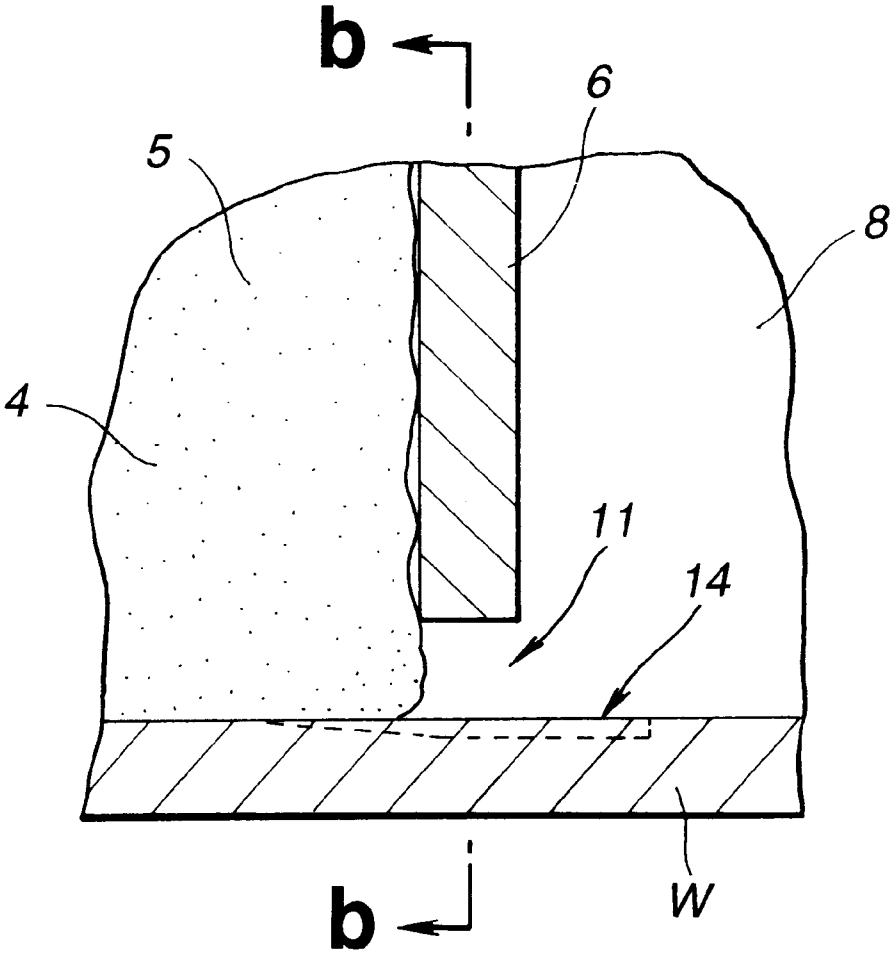

FIGS. 4(*a*) and 4(*b*) are diagrams illustrating the configuration of a surrounding structure of a communication port of an ink cartridge, serving as an ink tank, according to a third embodiment of the present invention: FIG. 4(*a*) is a cross-sectional view of a principal portion of the communication port, and FIG. 4(*b*) is a cross-sectional view taken along line b—b shown in FIG. 4(*a*).

The configuration of the third embodiment is basically the same as that of the first embodiment except for a communication port 11 (to be described below). Hence, the same components are indicated by the same reference numerals, and further description thereof will be omitted. The third embodiment has a feature in the shape of a liquid transfer channel provided at a lower portion of the communication port 11. In the first embodiment, the liquid transfer channel is configured by the projections projected from the upper surface of the wall w. To the contrary, the liquid transfer channel of the third embodiment is configured by a plurality of grooves 14 which extend to the inside of a lower portion of the negative pressure producing material 4 within the first ink chamber 5, and extend to the inside of the second ink chamber 8. The depth of the grooves 14 does not change from the second ink chamber 8 to a portion below the partition wall 6, and then gradually decrease in a portion below the negative pressure producing material 4.

In the third embodiment, the liquid transfer channel formed at a lower portion of the communication port 11 is configured by the grooves 14. As in the above-described case of the projections, it is desirable that the groove 14 has a width equal to or less than the diameter of the air bubble formed by gas-liquid exchange because the air bubble is prevented from entering the groove 14 and a transfer channel for the liquid can be secured. For example, as in the above-described case, the width may be equal to or less than 1 mm, and preferably, equal to or less than 0.5 mm. The groove 14 may have a depth to secure a transfer channel for the liquid in a state in which an air bubble remains. For example, considering that the formed air bubble has a diameter equal to or more than 1 mm, the width may be equal to or less than about 1 mm. Of course, a width equal to or more than 1 mm may be adopted provided that entering of an air bubble is prevented by the width of the groove 14. By thus providing the grooves 14, even if an air bubble remains within the communication port 11, the air bubble cannot enter the groove 14. Hence, a flowing channel only for ink can always be secured. As a result, ink within the second ink chamber 8 can be effectively consumed.

In the third embodiment, since the liquid transfer channel comprises recesses, the negative pressure producing material 4 is less deformed, so that a uniform negative-pressure distribution can be easily obtained.

Although in the third embodiment, the liquid transfer channel is configured by a plurality of recesses, projections as in the foregoing embodiments may be provided between adjacent recesses. In such a case, the difference between the apices of the projections and the bases of the recesses is appropriately adjusted so as to secure an ink flow channel where an air bubble does not enter which is formed at a lower portion of the communication port 11.

As described above, according to the present invention, even if an air bubble remains at an upper portion of the communication port, it is possible to assuredly and sufficiently supply ink within the second ink chamber to the first ink chamber through the liquid transfer channel provided at a lower portion of the communication port.

Even if an air bubble remaining in the communication port regulates the interface of ink within the second ink chamber to separate the interface of the ink from the communication port, ink within the first ink chamber can be assuredly supplied by providing a long liquid transfer channel so as to contact the interface of the ink.

The individual components shown in outline in the drawings are all well-known in the liquid tank arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid tank comprising:

a first chamber which incorporates a liquid and a negative pressure producing material and which includes an air communication port for obtaining communication with atmospheric air, and an ink outlet port; and a second chamber separated from the first chamber by a partition wall, the second chamber for directly accommodating liquid to be supplied to said first chamber in a substantially closed state except for communication with said first chamber only via a liquid communication port which is provided adjacent the partition wall at a position separated from the air communication port, the liquid communication port having a liquid transfer channel;

wherein a liquid transfer channel which is longer than a thickness of the partition wall is provided along an inner surface in the communication liquid port which is a bottom inner surface when the liquid tank is in use, wherein said liquid transfer channel comprises plural projections or grooves, and wherein an interval between said plural projections or a width of said grooves is equal to or less than 1 mm.

2. A liquid tank according to claim 1, wherein said liquid transfer channel is configured to be longer on said second chamber side than said first chamber side.

3. A liquid tank according to claim 1, wherein said liquid transfer channel is decreasingly sloped toward the negative pressure producing material in said first chamber.

4. A liquid tank according to claim 1, wherein the ink outlet port of said first chamber faces the air communication port, and is provided at a wall portion of said first chamber where said liquid transfer channel is formed.

5. A liquid tank according to claim 1, wherein the height of the plural projections or grooves is equal to or less than 1 mm.

6. A liquid tank according to claim 1, wherein the length of said liquid transfer channel is equal to or more than 2 mm.

* * * * *